United States Patent [19]

Polson

[11] Patent Number: 4,523,505

[45] Date of Patent: Jun. 18, 1985

[54] FOOD FEED CHUTE APPARATUS

[76] Inventor: Steven S. Polson, 1502 E. Lincoln Dr., Ambler, Pa. 19002

[21] Appl. No.: 546,753

[22] Filed: Oct. 28, 1983

[51] Int. Cl.[3] ..... B26D 3/30

[52] U.S. Cl. ..... 83/713; 83/409.2; 83/437; 83/872

[58] Field of Search ..... 83/437, 409.2, 355, 83/356.3, 703–730, 872, 874

[56] References Cited

U.S. PATENT DOCUMENTS

| | | | |
|---|---|---|---|
| 925,111 | 6/1909 | Lang et al. | 83/437 |
| 1,157,448 | 10/1915 | Stoltenberg . | |
| 1,200,428 | 10/1916 | Lawrence . | |
| 1,418,104 | 11/1921 | Spiselman . | |
| 1,442,222 | 1/1923 | Kirnbauer | 83/717 |
| 1,442,889 | 1/1923 | Kirnbauer | 83/437 |
| 2,209,295 | 9/1938 | Hjelte | 83/437 |
| 2,275,524 | 3/1942 | Gronich | 83/717 |
| 2,437,818 | 3/1948 | Hetzler | 83/437 |
| 3,760,715 | 9/1973 | Grote | 83/437 X |
| 3,774,487 | 11/1973 | Topliffe | 83/278 |
| 3,867,858 | 2/1975 | Tuchiya | 83/409.2 X |
| 3,979,982 | 9/1976 | Cole | 83/150 |
| 4,060,875 | 12/1977 | Gosling et al. | 83/278 X |
| 4,177,703 | 12/1979 | Cavier | 83/444 X |
| 4,356,205 | 10/1982 | Richards | 83/176 X |

*Primary Examiner*—James M. Meister

*Attorney, Agent, or Firm*—Panitch Schwarze Jacobs & Nadel

[57] ABSTRACT

The present invention relates to a food feed chute apparatus adapted for mounting upon a rotary cutting machine and comprises a base adapted to be mounted to the cutting machine, a tube having first and second ends being attached to the base at a location proximate the first end of the tube, the tube having a cross-sectional shape generally similar to the cross-sectional shape of the food products to be fed therethrough, but having cross-sectional dimensions about 1% to about 5% greater than the cross-sectional dimensions of the food products, and a weighted pusher disposable within the tube adapted for pushing the food products toward the first end of the tube. Preferably, the pusher is pivotably attached to the tube proximate the second end of the tube.

11 Claims, 7 Drawing Figures

FIG. 1
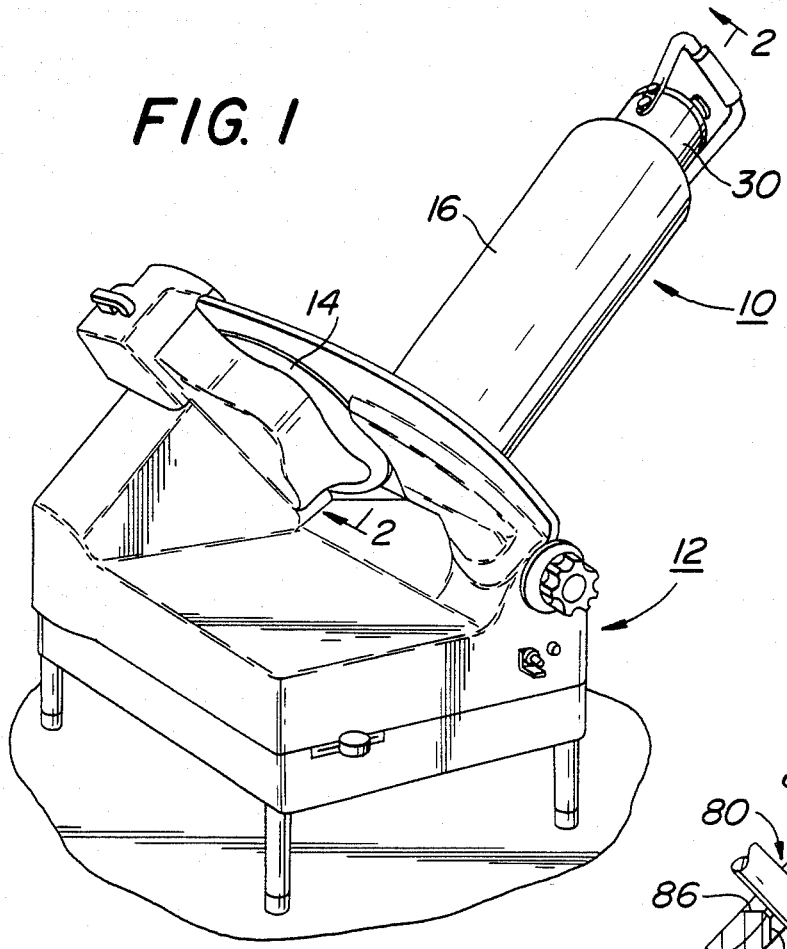
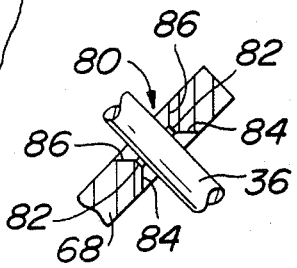
FIG. 6
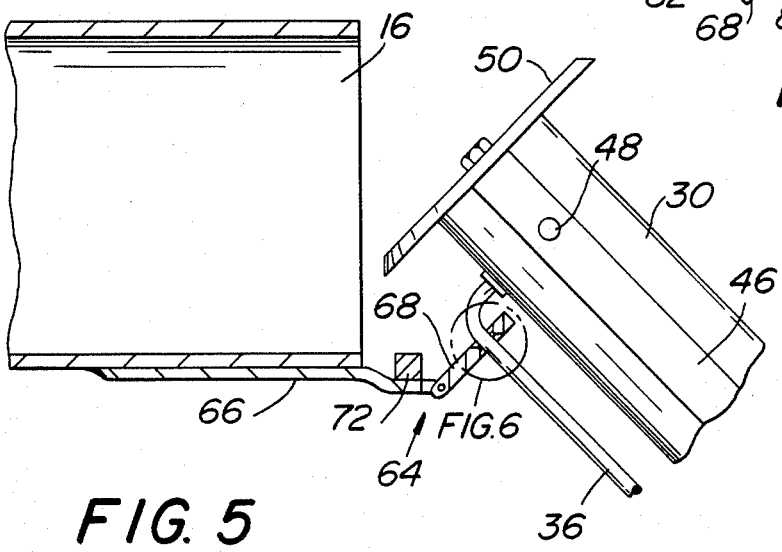
FIG. 5

FOOD FEED CHUTE APPARATUS

BACKGROUND OF THE INVENTION

This invention relates to a food feed chute apparatus, and particularly to such apparatus adapted for feeding food products to a machine having a rotary cutting blade so that the products can be sliced. The invention also relates to a process for feeding a stack of disc shaped food products to a rotary cutting machine in such a manner that the products are fed smoothly and without skewing to the cutting blade. The present invention is particularly well suited for slicing bagels.

Several food feed chute devices are known in the prior art, but none are particularly well suited for feeding disc shaped food products, such as bagels, to a rotary cutting blade. A typical commercial food chute is a vegetable chute sold by Berkel Incorporated of La Porte, Ind., as illustrated in its advertising sheet Form 4012-R177. There is no recognition that the tube portion of the feed apparatus should have a particular size and shape relationship to the food product being fed.

The same disadvantage is associated with various feeding mechanisms set forth in the following U.S. patents relating to food cutters and feed devices therefor: U.S. Pat. No. 1,157,448, issued Oct. 19, 1915 to Stoltenberg; U.S. Pat. No. 2,209,295, issued July 23, 1940 to Hjelte; U.S. Pat. No. 3,774,487, issued Nov. 27, 1973 to Topliffe; U.S. Pat. No. 3,979,982, issued Sept. 14, 1976 to Cole; and U.S. Pat. No. 4,060,875, issued Dec. 6, 1977 to Gosling, et al.

SUMMARY OF THE INVENTION

One aspect of the present invention concerns a food feed chute apparatus adapted for mounting upon a rotary cutting machine comprising a base adapted to be mountd to the cutting machine, a tube having first and second ends and being attached to the base at a location proximate the first end of the tube, a weighted pushing means disposable within the tube adapted for pushing food products to be fed through the tube toward the first end of the tube, and attaching means for pivotably attaching the pushing means to the tube proximate the second end of the tube.

Another aspect of the invention relates to a food feed chute apparatus adapted for mounting upon a rotary cutting machine comprising a base adapted to be mounted to the cutting machine, a tube having first and second ends and being attached to the base at a location proximate the first end of the tube, the tube having a cross-sectional shape generally similar to the cross-sectional shape of a food product to be fed therethrough, but having cross-sectional dimensions about 1% to about 5% greater than the cross-sectional dimensions of the food product, and a weighted pushing means disposable within the tube adapted for pushing the food product toward the first end of the tube.

The present invention is particularly designed for and well suited to slicing bagels, to make a product similar to "bagel chips." Other disc shaped food products are also well suited for slicing, such as doughnuts, English muffins, biscuits and the like. To cleanly slice these types of food products, particularly when they are loaded in a stack in a feed chute, they must be fed through the chute smoothly without skewing or misalignment and in a sufficiently positive manner to reach the blade such that the major plane of the product is approximately parallel to the plane of the cutting blade.

The apparatus of the present invention can be manufactured readily. The feed chute utilizes gravity in combination with a weighted pushing means to assure the consistent feeding of properly aligned food products to the cutting blade.

DEFINITIONS

As used herein, the "approximate diameter" of a food product means the length of the longest cross-sectional dimension of the food product in its major plane. As such, the term applies not only to products being approximately circular in cross-section, but also to irregularly shaped products, as well as to products of regular geometric cross-sectional shape.

As used herein, a food pushing disc has "dimensions approximately the same" as those of food products to be fed through when the dimensions of the disc are about the same as the approximate diameter of the food product, such that there is good surface contact between the pusher disc and the food product over substantially the entire surface between the food product and the pusher disc.

As used herein, a food product or other object is a "disc" or is "disc shaped" if it has a dimension in one plane significantly larger than the dimension in a perpendicular plane. Thus, it would be generally flat. Although a disc shaped object may have a circular cross-section, a circular cross-section is not required. Oval, elliptical, square, rectangular, triangular, or other regular or irregular cross-sectional shapes are also contemplated.

As used herein, a tube can have a "shape generally similar" to the shape of a food product to be fed therethrough when the tube has a shape to accommodate the food product such that the food product will not tend to skew or become misaligned as it travels through the tube toward the blade. It is preferred that food products having basically a circular cross-section, such as bagels, doughnuts, and the like, be fed through a tube having a circular cross-section, even though the food products do not have a perfectly circular cross-section, and may be slightly oval or irregularly shaped. Likewise, generally square cross-section should be fed through a tube having a square cross-section. However, even if the cross-sectional shape of the food product is different from that of the tube, if the cross-sectional dimensions of the food product with respect to the cross-sectional dimensions of the tube are such that skewing, binding, or misalignment of the product within the tube would most likely not occur, the food product could be fed through the tube in accordance with the present invention. Thus, for example, a food product having an eliptical cross-section could be fed through a tube having a circular cross-section. Likewise, if skewing or other feeding problems would not result, even a food product having a square cross-section could be fed through a tube having a circular cross-section.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 of the accompanying drawings is a perspective view illustrating the food feed chute apparatus according to the present invention attached to a rotary cutting machine.

FIG. 5 is a side elevation view, partly in longitudinally cross-section, of a portion of the apparatus illustrated in FIG. 2 in which the pusher is withdrawn from and pivoted partially away from the food tube of the apparatus.

FIG. 6 is an enlarged view of a portion of FIG. 5 within the circle labeled "FIG. 6."

DETAILED DESCRIPTION OF A PREFERRED EMBODIMENT

Figure 2:
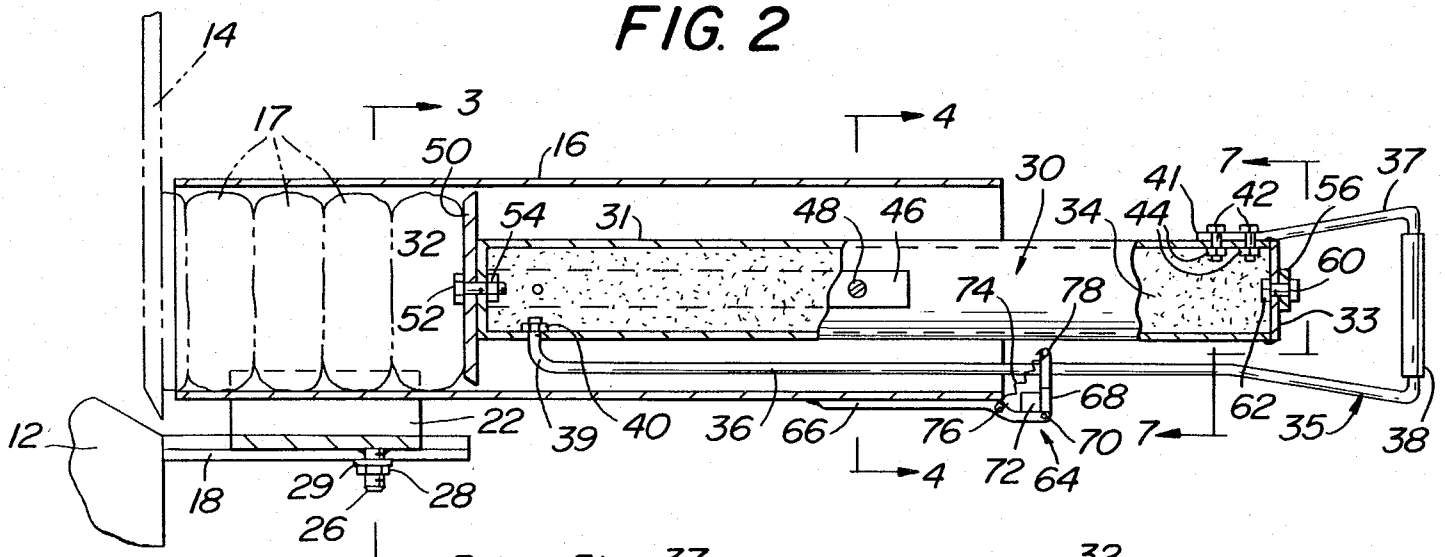
FIG. 2 is a side elevation view, partly in longitudinal cross-section, of the food feed chute apparatus according to the present invention.

Referring to the drawings in detail, wherein like numerals indicate like elements, there is shown in FIG. 1 a food feed chute apparatus 10 constructed in accordance with the present invention attached to a rotary cutting or slicing machine 12. The rotary cutting machine can be of any type of construction, preferably having a rotary cutting blade 14, such as various models made by Berkel Incorporated, for example its Model 818 slicer illustrated in the previously mentioned publication. The apparatus of the precent invention is mounted to a reciprocable mounting element for food feed attachments, which is a typical component of slicing machines, so the food product can be moved toward the cutting blade for slicing, and away from the blade to prepare for the next slice. Since the rotary cutting machine is conventional, it will not be described in detail.

It is important that apparatus 10 of the present invention be attached to the machine at a suitable angle, since the food product is fed through the apparatus by means of gravity. Further, the longitudinal axis of the apparatus should be oriented at about right angles with respect to cutting blade 14 to obtain the best slicing results. To obtain proper feeding of the food product, the chute apparatus of the present invention should be mounted on the cutting machine so that the longitudinal axis of the food tube component of the apparatus is at a mounting angle with respect to a horizontal baseline within a range of about 35 degrees to about 90 degrees. The presently preferred mounting angle is about 45 degrees, which allows the chute of the present invention to be attached to commercial slicing machines such that the chute is at about a right angle to the cutting blade, all without modifying the slicing machine.

Generally, with a steeper mounting angle, the food product can be fed more efficiently and with less likelihood that the food product will skew at it is being fed and less likelihood that the food product being sliced or others in the stack will be displaced will it is being sliced. However, this efficiency of feeding and slicing must be counterbalanced by the adaptability to mount the food chute of the present invention on slicing machines currently in use, while still maintaining the proper cutting angle.

One major components of the present invention is a food tube 16 into which food products 17 (illustrated in phantom in FIG. 2) are placed. As explained above, the present invention is ideally suited for slicing individual disc shaped food products contained in a stack, and is particularly adapted for slicing bagels.

One novel feature of the present invention is the recognition to use a food tube having particular cross-sectional shape and dimensions which are generally similar to but slightly greater than the food product to be fed therethrough. It is important that the tube not be so large in cross-sectional dimension compared to the food product that the food product is likely to skew, bind, become misaligned, or turn as it is fed through the tube or as the product is being sliced. It is believed that for best feeding and slicing results, the food tube should have a cross-sectional shape generally similar to the cross-sectional shape of the food product to be fed therethrough, but having dimensions about 1% to about 5% greater than the dimensions of the food product.

The exact dimensions may be varied, depending upon the type and shape of food product to be fed and sliced, but generally, as the mounting angle increases, the food tube can be more nearly the diameter of the food product. Thus, for example, if the food tube were to be mounted at a 90 degree angle with respect to a horizontal baseline, it may only be necessary that the cross-sectional dimensions of the food tube be about 1% greater than the cross-sectional dimensions of the food product. Toward the low end of the mounting angle range, on the order of 35 degrees, the food tube should have cross-sectional dimensions about 5% greater than those of the food product. At the presently preferred mounting angle of 45 degrees, it is preferred that the cross-sectional dimensions of the food tube be about 3% to about 5% greater than those of the food product.

It should be apparent to those skilled in the art, based upon the above criteria, that the food tube can have any desired regular or irregular cross-sectional shape. Since one primary intended use of the present invention is the feeding of a stack of bagels, food tube 16 is illustrated as having a preferred circular cross-sectional shape. Typical dimensions for food tube 16 are, for example, 16 inches in length, with an outside diameter of about 4-9/16 inches and an inside diameter of about $4\frac{3}{8}$ inches. Even though bagels are not precisely circular in cross-section, the present invention operates very well as a bagel feed chute.

Tube 16, as well as most other components of the present invention, can be made from a variety of materials. The materials used should be durable, easy to clean and maintain, and not affect the taste of any food product to be fed therethrough. The presently preferred material for tube 16 is stainless steel.

Tube 16 is mounted onto cutting machine 12 by a mounting means which cooperates with a mounting support 18 of the slicing machine in a conventional manner such as used with other types of feeding trays. Machine mounting support 18 includes a longitudinal channel 20 and a longitudinal slot 21. A tube mounting base 22, preferably made of stainless steel, is attached to tube 16 in any suitable manner, such as by stainless steel welds. Tube mounting base 22 includes an elongated extension 24 cooperable with channel 20 of machine mounting support 18. A threaded shaft 26 can be formed integrally with or otherwise secured to extension 24. A nut and washer 28 and 29, respectively, secured tube mounting base 22 to machine mounting support 18.

Machine mounting support 18 and attached apparatus 10 reciprocate toward and away from cutting blade 14 in the usual manner when the present invention is secured to the machine mounting support. As clearly shown in FIG. 2, tube mounting base 22 is secured to tube 16 proximate a first end thereof spaced slightly from the cutting blade. The amount of spacing can be adjusted simply by adjusting the location of tube mounting base 22 within channel 20 and slot 21 of machine mounting support 18. In addition, some slicing machines allow the space to be adjusted by allowing adjustment of the entire support 18, even if the mounting of a feeding accessory to the machine mounting support is not adjustable itself.

To assure smooth and consistent feeding of the food product through tube 16, the present invention includes the use of a weighted pushing means, such as weighted pusher 30. Pusher 30 preferably is in the shape of an elongated tube 31 having first and second end caps 32 and 33 secured thereto after the tube is filled with a suitable weighted material 34, such as lead. In the embodiment illustrated in the drawings, pusher 30 also is made of stainless steel and has a length of about 15½ inches and a diameter of about 2 inches.

The amount of lead or other weight to be contained in pusher 30 can be determined by the user's specifications, including the mounting angle of the apparatus with respect to a horizontal baseline, the type of food product, the strength of the person who is expected to use the apparatus, and the like. In general, if the mounting angle of apparatus 10 with respect to a horizontal baseline is on the order of 90 degrees, less weight is necessary than if the mounting angle is low, on the order of 35 degrees.

Although the amount of weight can vary within a wide range, a suitable weight range for most food products over the wide range of angles for most users is believed to be from about 7 pounds to about 15 pounds. When the mounting angle is about 45 degrees, and when the food product includes a stack of bagels, the apparatus works very effectively when pusher 30 weighs about 10 pounds.

A pushing disc or plate 50 is attached by any suitable fastening means, such as bolt 52 and nut 54 to the first end of pusher 30. In many instances, it may be preferable to use a flat-headed fastener to secured disc 50 to pusher 30 so that the fastener does not mar the food product or tend to cause misalignment or misfeeding of the feed product through tube 16.

Figure 3:
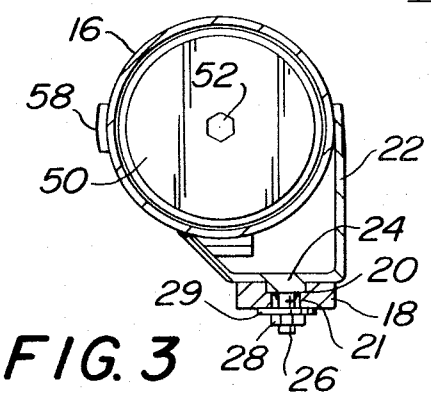
FIG. 3 is a transverse cross-sectional view of the apparatus taken along line 3—3 of FIG. 2, but not including the food products illustrated in phantom in FIG. 2.

As illustrated in FIGS. 2 and 3, disc 50 has a cross-sectional shape generally similar to that of the food product to be fed through tube 16, and has slightly smaller cross-sectional dimensions than the inside dimensions of tube 16. Maximum bearing surface contact between disc 50 and the adjacent food product is desirable to prevent twisting or misfeeding of the food product. In the presently preferred embodiment illustrated in the drawings, disc 50 has a diameter of about 4⅛ inches. Preferably, it is made of stainless steel.

A stop bar 56 or other limit stop means is attached to pusher 30 at the second end by suitable fasteners, such as bolt 60 and nut 62. The purpose of stop bar 56 (best illustrated in FIG. 7) is to prevent pusher 30 from travelling too far within tube 16 and to prevent it from contacting blade 14. Preferably, the ends of stop bar 56 are covered or coated with rubber or other suitable polymeric protective material to reduce wear and cushion the bar when it contacts the second end of tube 16 when the stack of food products has been sliced completely.

There are two types of guiding means attached to pusher 30 to assure that it travels in a smooth, non-binding manner within tube 16, regardless of the mounting angle of the tube with respect to a horizontal baseline. At least two low friction guide bars 46 and 47 should be attached to tube 31 of pusher 30 by suitable means, such as screws 48 and 49. Guide bars 46 and 47 should be made of some low friction polymeric material, such as nylon, polytetrafluoroethylene or other similar low friction material. The guide bars are spaced very slightly from the inside walls of tube 16 to assure smooth sliding travel of pusher 30 within tube 16. Although two guide bars 46 and 47 are illustrated, three or, if desired, more guide bars could be used. Two guide bars have been found to provide an effective operation.

The other means for guiding pusher 30 through tube 16 is guide rod assembly 35, best illustrated in FIG. 2. The major portion of guide rod assembly 35 is an elongated, straight, guiding portion 36 which is spaced from but generally parallel to the longitudinal axis of pusher 30 and tube 16. Preferably, the guide rod assembly is made from a one piece stainless steel rod, about 5/16 inch in diameter, which is bent to form the component portions of the guide rod assembly.

Guide rod assembly 35 includes an integral handle portion 37. Preferably, a cushioning grip 38 made of rubber or other similar material embraces at least a part of handle portion 37.

A first end portion 39 of guide rod assembly 35 is attached to pusher 30, proximate the first end of the pusher, by means of a threaded nut connection or the like as illustrated at 40. Other suitable fastening means, such as welding, may be utilized if desired. If it presently preferred that the fastening connection be removable if desired.

Likewise, the other end portion 41 of guide rod assembly 35 may be attached by any suitable means, such as screws 42 and nuts 44 to the pusher 30, proximate the second end of the pusher.

Guide rod assembly 35 performs several simultaneous functions. Its primary functions are to assist in guiding pusher 30 through tube 16 while serving to pivotably attach pusher 30 to tube 16 by cooperating with a pivotable attaching means, such as hinge assembly 64. Another function of guide rod assembly 35 in the embodiment illustrated in the drawings is as a handle. However, guide rod assembly 35 need not have a handle integrally formed therewith. Instead, guide rod assembly 35 could be attached to the second end of pusher 30 in the same manner it is attached to the first end of pusher 30. A separate handle could be attached to the second end of pusher 30.

Figure 7:
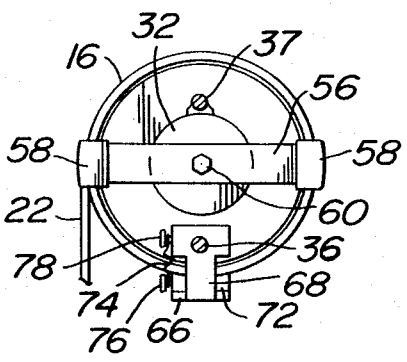
FIG. 7 is an end elevational view, and partly in transverse cross-section, of the apparatus taken along lines 7—7 of FIG. 2.
Figure 4:
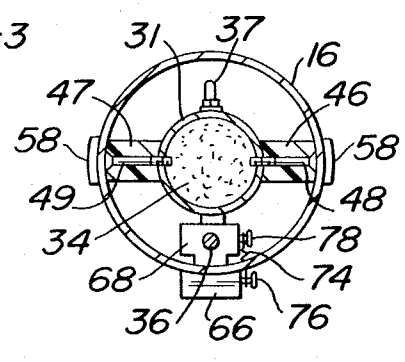
FIG. 4 is a transverse cross-sectional view of the apparatus taken along line 4—4 of FIG. 2.

The guiding function of guide rod assembly 35 is best illustrated in FIGS. 2, 4 and 7. Elongated guiding portion 36 of guide rod assembly 35 must remain parallel to the longitudinal axis of pusher 30 and tube 16. Hinge assembly 64 plays an important role not only in the attachment of pusher 30 to tube 16, but also in guiding pusher 30 through tube 16 as is set forth in more detail below.

Hinge assembly 64 preferably is made of stainless steel, and includes a fixed member 66 attached to tube 16 by any suitable means, such as stainless steel welding. A movable member 68 is pivotably attached to fixed member 66 by a pintle 70. A stop member 72 (best seen in FIGS. 2 and 5) is securely fastened to fixed member 66, again preferably by welding. When movable member 68 abuts stop member 72, the major plane of movable member 68 is perpendicular to the axial plane of tube 16 and pusher 30. This keeps elongated guiding portion 36 of guide rod assembly 35 oriented in the correct position as portion 36 slides through orifice 80 in member 68 during the travel of pusher 30 through tube 16.

A biasing means, such as a tension spring 74, normally urges or biases movable member 68 toward member 66 until member 68 abuts stop member 72. One end of spring 74 is attached to a pin or screw 76 fastened to fixed member 66. The order end of spring 74 is attached to a pin or screw 78 fastened to movable member 68.

The pivotable attachment of pusher 30 to tube 16 is best illustrated in FIG. 5, in which the pusher has been fuly withdrawn from tube 16 and elongated portion 36 of guide rod assembly 35 slid through the orifice in member 68. Once the first end of pusher 30 has been withdrawn from tube 16, the pusher can be pivoted completely out of the way (clockwise in the orientation illustrated in FIG. 5) so that a new supply of food products can be loaded into tube 16 to be fed to the slicer 12.

To help guiding portion 36 slide smoothly through orifice 80, the side walls of the orifice converge toward the middle as illustrated at 82 in FIG. 6. In other words, the side walls of orifice 80 diverge from the middle toward both the entry end 84 and the exit end 86. This construction allows guiding portion 36 to slide smoothly through movable member 68 of the hinge assembly without binding. There should be suitable clearance between the surface of guiding portion 36 and the walls of the orifice to allow non-binding sliding movement, but not such a large clearance that the guiding function of guiding portion 36 is not effective. If guiding portion 36 has a diameter of about 5/16 inch in the preferred embodiment, the minimum diameter of orifice 80 should be about ⅜ inch, for example.

As best illustrated in FIGS. 2, 4 and 5, it is preferred that where two guide bars 46 and 47 are used, guiding portion 36 of guide rod assembly 35 should be oriented about 90 degrees with respect to the guide bars.

It is believed that the operation of the apparatus according to the present inventon and the performance of the process of the present invention is clear from the detailed description set forth above. However, the operation may be summarized as follows.

After mounting food feed chute apparatus 10 to a machine mounting support 18 which is reciprocable toward and away from a cutting blade, pusher 30 is withdrawn from tube 16 and pivoted away from the second or loading end of the tube. A stack of food products, such as bagels, is inserted into tube 16. The pusher is then pivoted back into axial alignment with tube 16 and inserted into the loading end of the tube. Disc 50 of pusher 30 bears against the outermost food product within the tube and due to gravity the weight of the pusher through an appropriately sized and dimensioned disc 50 exerts sufficient pressure on the food products to cause them to feed through tube 16. Because the cross-sectional shape and dimensions of food tube 16 and disc 50 are matched to those of the food product, in the relationship set forth above, the food product is fed smoothly and consistently, without skewing, twisting, binding, misaligning or misfeeding toward the cutting blade while the apparatus of the present invention reciprocates as the food product is sliced.

The present invention may be embodied in other specific forms without departing from the spirit or the central attributes thereof and, accordingly, reference should be made to the appended claims, rather than to the foregoing specification as indicating the scope of the invention.

I claim:

1. A food feed chute apparatus adapted for mounting upon a rotary cutting machine comprising a base adapted to be mounted to the cutting machine, a tube having first and second ends and being attached to the base at a location proximate the first end of the tube, a weighted pushing means disposable within the tube adapted for pushing food products to be fed through the tube toward the first end of the tube, and attaching means for pivotably attaching the pushing means to the tube proximate the second end of the tube, the attaching means comprising a fixed member fixedly attached to the tube, a movable member, means for pivotably attaching the movable member to the fixed member, and a guide rod attached at its ends to the pushing means, the guide rod having an elongated portion which is spaced from the pushing means and having an axis parallel to the axis of the pushing means, the elongated portion of the guide rod extending through an orifice in the movable member.

2. Apparatus according to claim 1 wherein the pushing means comprises an elongated weight having first and second ends and includes low friction guide bars on the outside surface thereof for guiding the pushing means smoothly within and along the length of the tube.

3. Apparatus according to claim 2 wherein the pushing means further comprises a bearing disc oriented in a plane perpendicular to the longitudinal axis of the pushing means and attached to the first end of the pushing means which extends within the tube toward the first end of the tube, the bearing disc having cross-sectional dimensions approximately the same as those of food products to be fed through the tube, whereby pressure is exerted against the food products by the disc and pushing means to keep the food products substantially aligned within the tube as they travel within the tube toward the first end thereof.

4. Apparatus according to claim 1 wherein the pivotable attaching means includes a stop means for stopping the motion of the movable member toward the fixed member when the pushing means is inserted into the tube, and wherein the pivotable attaching means further includes biasing means to bias the movable member toward the fixed member.

5. Apparatus according to claim 4 wherein the stop means and biasing means cooperate to orient the movable member to an angle of about 90 degrees with respect to the longitudinal axis of the tube when the pushing means is within the tube.

6. Apparatus according to claim 4 wherein the orifice has side walls converging in the center thereof.

7. Apparatus according to claim 1 wherein the tube has a cross-sectional shape generally similar to the cross-sectional shape of the food products to be fed therethrough, but has cross-sectional dimensions about 1% to about 5% greater than the cross-sectional dimensions of the food product.

8. Apparatus according to claim 7 wherein the tube has cross-sectional dimensions about 3% to about 5% greater than the cross-sectional dimensions of the food products.

9. Apparatus according to claim 8 wherein the tube is adapted to be mounted on the cutting machine so as to have a mounting angle with respect to a horizonal baseline within a range of about 35 degrees to about 90 degrees.

10. Apparatus according to claim 9 wherein the tube is cylindrical, the food products are bagels, and the mounting angle is 45 degrees.

11. Apparatus according to claim 1 wherein the tube is adapted to be mounted on the cutting machine so as to have a mounting angle with respect to a horizontal baseline within a range of about 35 degrees to about 90 degrees.

* * * * *